United States Patent [19]

Caldares

[11] Patent Number: 4,484,529

[45] Date of Patent: Nov. 27, 1984

[54] MULTIPLE PLACE SETTING TABLECLOTH ARRANGEMENT

[76] Inventor: Patricia L. Caldares, 8429 Vicara Dr., Alta Loma, Calif. 91701

[21] Appl. No.: 469,919

[22] Filed: Feb. 25, 1983

[51] Int. Cl.[3] ..... A47B 13/08

[52] U.S. Cl. ..... 108/90; D6/618; 108/161

[58] Field of Search ..... D6/275, 276, 271; 108/28, 90, 161; 150/52 R, 52 C; 206/390; 248/346.1, 346

[56] References Cited

U.S. PATENT DOCUMENTS

| | | | |
|---|---|---|---|
| D. 133,161 | 7/1942 | Hollis | D6/276 X |
| D. 264,790 | 6/1982 | Kamel et al. | D6/271 |
| 1,384,908 | 7/1921 | Lockwood | D6/276 X |
| 1,385,695 | 7/1921 | MacCormack et al. | 150/52 R |
| 2,436,237 | 2/1948 | Brandt | 150/52 R |
| 3,156,280 | 11/1964 | Affholter | 150/52 R |
| 3,939,976 | 2/1976 | Vanlseghem | 150/52 R |

*Primary Examiner*—James T. McCall

*Attorney, Agent, or Firm*—William P. Green

[57] ABSTRACT

A tablecloth having a central portion on which serving pieces may be placed, with a series of individual dining portions of the tablecloth projecting outwardly from the central portion at spaced locations and having individual place settings on these different portions, and with the tablecloth having cutaway areas between the individual dining portions and at which the table top is directly visible to give the overall assembly a unique and pleasing appearance.

6 Claims, 6 Drawing Figures

MULTIPLE PLACE SETTING TABLECLOTH ARRANGEMENT

BACKGROUND OF THE INVENTION

This invention relates to improved tablecloths and table setting arrangements.

A disadvantage of conventional tablecloths for dining room tables is that the usual cloth conceals entirely from view the top surface of the table, which may have a very expensive and attractive wood grain finish. Placemats may be substituted for a full tablecloth, leaving portions of the table top visible, but such placemats do not afford adequate protection to the table top at locations where serving dishes and the like may be placed.

SUMMARY OF THE INVENTION

The major purpose of the present invention is to provide an improved tablecloth and table setting arrangement and method which leaves uncovered substantial portions of the upper surface of the table top, to present an extremely pleasing overall appearance in which the tablecloth and the exposed wood grain finish or other finish of the table top itself complement one another and give the set table an appearance more attractive than a table with either a full cloth or placemats. At the same time, the tablecloth of the present invention is designed to protect the table top from damage by contact with serving pieces or the like more effectively than when placemats are employed.

To attain these results, an arrangement embodying the invention includes a tablecloth having a central portion which covers a central part of the table top, and on which serving dishes, bowls, and other serving pieces may be placed in a manner protecting the table top therefrom, with the cloth having a series of individual dining portions projecting outwardly from the central portion of the tablecloth and toward the periphery of the table top at locations spaced about the table. Individual place settings are positioned on these individual dining portions of the tablecloth, including plates and eating utensils. Between the individual dining portions, the tablecloth is provided with a cutaway areas extending inwardly toward the central portion of the tablecloth and designed to leave substantial areas of the table top exposed to view. In most instances, at least two of the individual dining portions are provided at each side of a conventional rectangular or other oblong table, with a cutaway region therebetween, with single dining portions at each end of the table. Preferably, each dining portion has a width of at least about eighteen inches, and projects outwardly beyond the main central portion of the tablecloth at least about ten inches.

BRIEF DESCRIPTION OF THE DRAWINGS

The above and other features and objects of the invention will be better understood from the following detailed description of the typical embodiments illustrated in the accompanying drawings, in which.

DESCRIPTION OF THE PREFERRED EMBODIMENTS

Figure 1:
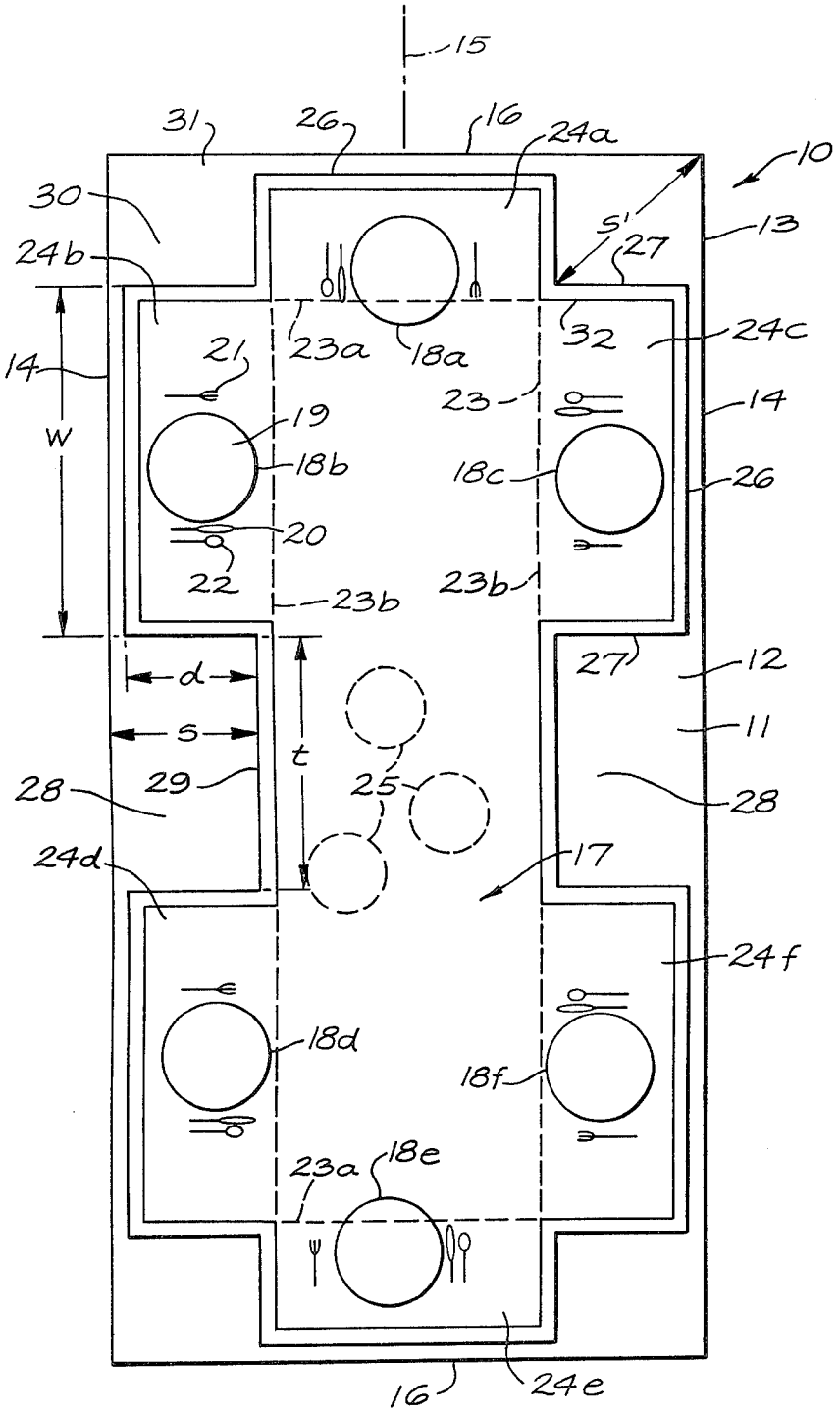
FIG. 1 is a plan view of a first dining table arrangement embodying the invention.

The table setting arrangement of FIG. 1 includes a table 10 having a table top 11 which is typically illustrated as of rectangular horizontal section, with a flat horizontal upper surface 12 having a peripheral edge 13 with side edge portions 14 extending parallel to the longitudinal axis 15 of the table, and transverse end edge portions 16 shorter than side edges 14 and perpendicular thereto. Positioned on the upper surface 12 of the table top is a tablecloth 17 covering part but not all of the table top and on which a number of place settings 18*a*, 18*b*, 18*c*, 18*d*, 18*e* and 18*f* are located. Each of the place settings is represented as including a dinner plate 19 and eating utensils preferably including at least one knife 20, at least one fork 21 and at least one spoon 22, all arranged in the usual manner.

The tablecloth 17 may be considered as having a main central portion 23 (outlined in broken lines in FIG. 1) and a series of individual dining portions 24*a*, 24*b*, 24*c*, 24*d*, 24*e* and 24*f* connected to central portion 23 and projecting outwardly therefrom toward the peripheral edge 13 of the table top. Main portion 23 is generally rectangular and elongated in the direction of the longitudinal axis 15 of the table top, in essential correspondence therewith, but is substantially smaller than the table top as shown. The broken line defining the central main portion of the tablecloth may extend transversely of the length of the table top at 23*a* near opposite ends of the table and extend longitudinally of the table near opposite sides thereof at 23*b*. This fairly large central portion 23 thus provides a substantial area on which serving dishes, bowls or other items represented at 25 may be placed to protect the table top against direct contact therewith.

Each of the individual dining portions 24*a*, 24*b*, 24*c*, 24*d*, 24*e* and 24*f* of the tablecloth may be considered as projecting outwardly beyond the edges 23*a* or 23*b* of central portion 23, and toward the peripheral edge 13 of the table top. It is contemplated that each of these individual dining portions 24*a*, 24*b*, etc. may terminate outwardly at an edge 26 which is closely proximate to and essentially parallel to the corresponding portion of the peripheral edge of the table top, or alternatively, the edge 26 of each dining portion 24*a*, 24*b*, etc. may if desired project outwardly somewhat beyond the peripheral edge of the table top and actually hang downwardly at that edge. The sides of each individual dining portion 24*a*, 24*b*, etc. may be defined by two typically parallel side edges 27 of the individual dining portion, so that in the FIG. 1 arrangement each such dining portion is essentially rectangular.

In a rectangular table arrangement as represented in FIG. 1, there are normally at least two of the individual dining portions at each side of the table (for example, portions 24*b* and 24*d* at the left side in FIG. 1 and portions 24*c* and 24*f* at the right side in that figure, and a single individual dining portion at each end (24*a* and 24*e*). Between the two dining portions at each side, the tablecloth has a cutaway area 28, which in the illustrated arrangement is defined by two of the side edges 27 of adjacent individual dining portions and an edge 29 extending therebetween and forming part of the edge of the enlarged central portion 23 of the tablecloth. The surface of the table top is exposed to view at the location of these cutaway areas 28, to enhance the overall appearance of the general arrangement by enabling diners to see the wood grain finish of the table top. At the four corners of the table top, there are additional cutaway areas 30, defined by two of the edges 27 of adjacent side and end individual dining portions, to reveal corner portions of the table top at 31. The tablecloth of FIG. 1 has typically been represented as having a narrow border portion 32 extending along its entire periphery and formed of a different type of material or different color of material than the rest of the tablecloth.

The width dimension w of each of the individual dining portions 24*a*, 24*b*, 24*c*, etc. of the tablecloth is great enough to allow positioning of a place setting thereon, and for this reason should in most instances be at least about fifteen inches, preferably approximately nineteen inches. The dimension d which represents the depth of each of the individual dining portions, and the depth dimension of each of the cutaways 30, should preferably be at least about seven inches. The maximum spacing s or s' between the edge of the tablecloth and the edge of the table at the location of each of the cutaways 28 and 30 should also preferably be at least about seven inches. The width t of the side cutaways 28 should in most instances be at least about one-half of the width w of the individual dining portions between which it is located, and desirably at least about seven inches.

In using the table setting of FIG. 1, persons seated at the various individual dining areas have place settings located on the dining portions 24*a*, 24*b*, etc. and thus protected against contact with the table top, and have access to serving pieces 25 on the large central portion 23 of the tablecloth, but with the intermediate portions of the table top at the locations of cutaways 28 and 30 being exposed to view as previously discussed to provide a highly effective and attractive overall appearance in which the table top is protected and yet exposed to view at strategic locations to complement the appearance of the cloth itself and the various items thereon.

Figure 2:
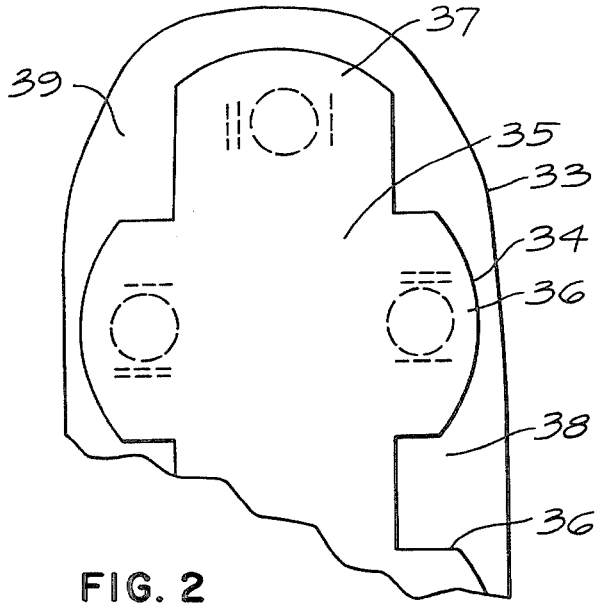
FIGS. 2 through 6 are plan views of variational arrangements, with the assemblies of FIGS. 2, 3 and 6 being shown fragmentarily.

The variational arrangement fragmentarily illustrated in FIG. 2 includes a dining table having a top 33 of oval rather than rectangular configuration, with a tablecloth 34 having a central portion 35 covering the middle of the top for receiving serving dishes, and with individual dining portions connected to the central portion and projecting laterally therefrom toward the periphery of the table top and typically including two portions 36 at each side and one portion 37 at each end of the table. Cutaway regions 38 between the side dining portions and 39 at the corners of the tablecloth provide exposed areas at which the table top itself is visible for the purposes previously discussed. The preferred dimensions of the cutaway regions and the individual dining areas, and the spacing of the central portion of the tablecloth from the edge of the table, are desirably essentially the same in FIG. 2 as described above in connection with FIG. 1. The same is true of the dimensions of the FIGS. 3, 4, 5 and 6 forms of the invention described below.

Figure 3:
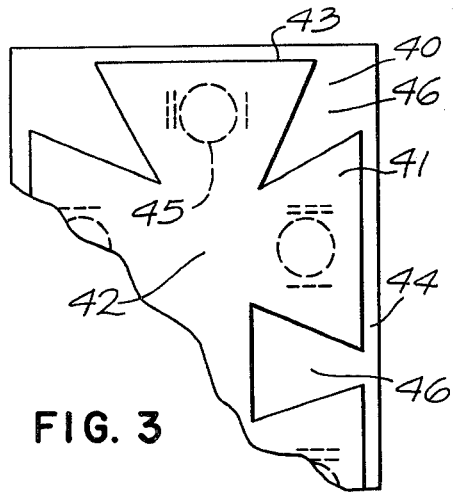

In FIG. 3, a tablecloth 40 has side individual dining portions 41 projecting from its main central portion 42 and end portions 43, with all of the portions 41 and 43 illustrated as flaring to increased width as they advance toward the peripheral edge of the table top 44. Individual place settings represented diagrammatically at 45 are positioned on the different individual dining portions, with the cutaway regions 46 between the various individual dining portions leaving exposed areas of the table top open to view.

Figure 4:
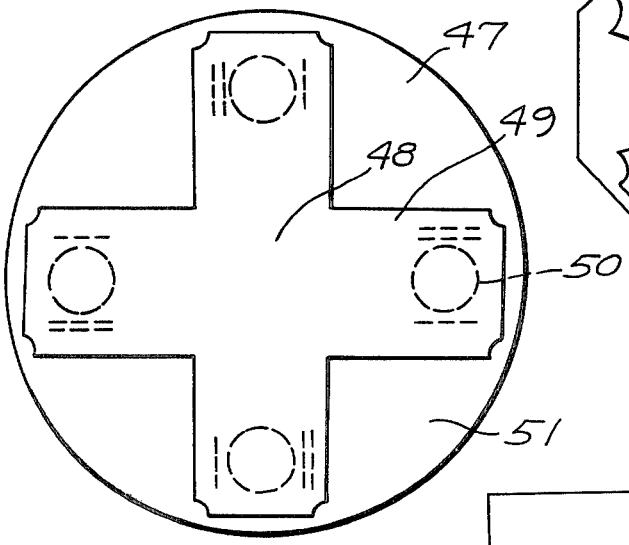

In FIG. 4, a typically round table 47 has a tablecloth with a central portion 48 and four individual dining portions 49 projecting in different directions therefrom to carry individual place settings represented at 50, with cut-aways 51 between the individual dining portions leaving areas at which the table top is visible.

Figure 5:
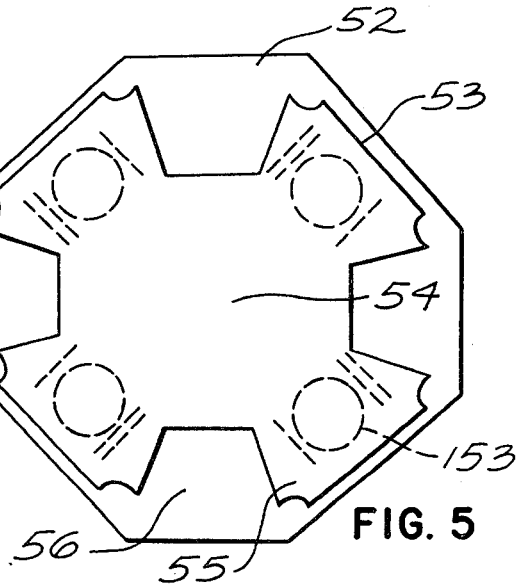

In FIG. 5, there is represented an octagonal table top 52 having a tablecloth 53 with a central portion 54 and four individual dining portions 55 projecting in different directions toward different ones of the eight sides of the table, and with those portions 55 and the intermediate cutaway areas 56 preferably increasing in width as illustrated as they advance laterally outwardly toward the periphery of the table top, as shown. As in the other form of the invention, place settings represented at 153 are located on the portions 55 of the tablecloth, and serving dishes or utensils can be placed on the central region 54.

Figure 6:
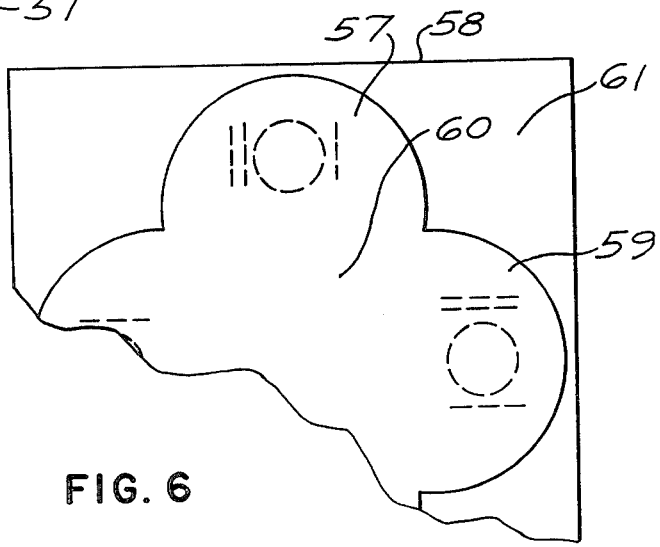

FIG. 6 shows another form of the invention in which the tablecloth 57 is represented as located on a square table 58, and has peripherally curving individual dining portions 59 projecting outwardly from a central portion 60, with areas 61 between the portions 59 and at which the spacing between the periphery of the table top and the edge of the table is greater than at the locations of the individual dining portions 59, to leave substantial portions of the table top exposed to view.

While certain specific embodiments of the present invention have been disclosed as typical, the invention is of course not limited to these particular forms, but rather is applicable broadly to all such variations as fall within the scope of the appended claims.

I claim:

1. A tablecloth comprising:

a main central portion of the cloth adapted to cover a central part of the top of a dining table and on which serving pieces may be placed; and individual dining portions of the tablecloth connected to said central portion and projecting laterally therefrom at spaced locations to cover corresponding portions of the table top at different sides of the table;

said individual dining portions being dimensioned to each receive an individual place setting including a plate, knife, fork and spoon;

said tablecloth having cutaway areas between successive ones of said individual dining portions dimensioned to leave substantial areas of the top of the table exposed between said individual dining portions and said place settings thereon.

2. A tablecloth as recited in claim 1, in which said individual dining portions of the tablecloth have a width of at least about fifteen inches and a depth inwardly toward the center of the tablecloth of at least about seven inches.

3. A tablecloth as recited in claim 1, in which said cutaway areas of the tablecloth have a maximum width which is at least about one-half the minimum width of said individual dining portions.

4. A tablecloth as recited in claim 1, in which said tablecloth has a length dimension between opposite ends thereof and a smaller width dimension between two opposite sides of the tablecloth, said tablecloth having at least two of said individual dining portions spaced apart at each of said sides and having one of said individual dining portions at each of said ends.

5. A tablecloth having a length dimension between opposite ends thereof and a smaller width dimension between two opposite sides thereof, and comprising:

a central portion of the tablecloth adapted to cover a central region of a table top and on which serving dishes can be placed; and a series of individual dining portions of the tablecloth connected to said central portion and projecting outwardly therefrom at spaced locations;

there being at least two of said individual dining portions at each of said sides of the tablecloth with a cutaway area between said two individual dining portions at each side for exposing the table top therebetween;

there being two of said individual dining portions projecting in opposite directions at said two ends respectively of the tablecloth;

said tablecloth having corner cutaway areas at opposite sides of each of said end individual dining portions and between said end dining portions and said side dining portions for exposing corner portions of the table top to view.

6. A tablecloth as recited in claim 5, in which each of said individual dining portions of the tablecloth has a width of at least about fifteen inches and a depth inwardly toward the center of the table of at least about seven inches, each of said first mentioned cutaway areas between the individual dining portions at opposite sides of the tablecloth having a width of at least about seven inches and a depth inwardly toward the center of the tablecloth of at least about seven inches.

* * * * *